United States Patent [19]

Rosen

[11] 4,013,082

[45] Mar. 22, 1977

[54] TOBACCO EXPANSION PROCESS

[76] Inventor: William E. Rosen, 2055 Wisteria Lane, Lafayette Hill, Pa. 19444

[22] Filed: Feb. 12, 1975

[21] Appl. No.: 549,226

Related U.S. Application Data

[63] Continuation of Ser. No. 292,183, Sept. 25, 1972, abandoned, which is a continuation-in-part of Ser. No. 279,851, Aug. 11, 1972, Pat. No. 3,889,689.

[52] U.S. Cl. ..... 131/140 P

[51] Int. Cl.[2] ..... A24B 3/18

[58] Field of Search ..... 131/140 P, 140 C, 143, 131/142, 2, 17, 15

[56] References Cited

UNITED STATES PATENTS

| | | | |
|---|---|---|---|
| 3,364,935 | 1/1968 | Moshy et al. | 131/140 C |
| 3,612,065 | 10/1971 | Rosen | 131/142 A |
| 3,683,937 | 8/1972 | Fredrickson et al. | 131/143 |
| 3,710,803 | 1/1973 | Johnson | 131/140 P |

*Primary Examiner*—Robert W. Michell
*Assistant Examiner*—V. Millin

[57] ABSTRACT

A method of expanding tobacco is described which involves the use of negative pressure to cause oxygen gas resulting from the reaction of catalase and hydrogen peroxide to form large bubbles in the cell interstices and greatly expand the tobacco.

9 Claims, No Drawings

TOBACCO EXPANSION PROCESS

This is a continuation of U.S. application Ser. No. 292,183, filed 9/25/72, now abandoned, which is a continuation in-part of Ser. No. 279,851 filed Aug. 11, 1972, entitled Method Of Treating Tobacco with Catalase and Hydrogen Peroxide, now U.S. Pat. No. 3,889,689.

BACKGROUND OF THE INVENTION

1. Field of the Invention

This invention relates to a method of expanding tobacco and more particularly relates to a method for more efficiently and economically inducing expansion.

2. Description of the Prior Art

In my U.S. Pat. No. 3,612,065 the disclosure of which is incorporated herein by reference and made a part hereof, I have described a method of treating tobacco wherein a given amount of catalase provided on said tobacco is reacted with a given amount of hydrogen peroxide in contact therewith, the mutual decomposition of catalase and hydrogen peroxide being effective to increase the volume of the tobacco up to 20%. This puffing capacity can be increased by forcing the hydrogen peroxide and catalase into the cell interstices.

Other prior art methods of treating tobacco to increase the volume thereof require the use of expensive solvents and complex solvent recovery systems. Some chemical solvents may affect the tobacco taste or leave a toxic residue. It is important to be able to puff tobacco up to at least 150 per cent without wetting the tobacco so that there is not a loss of soluble tobacco material and so that drying the tobacco does not become an expensive operation. It is known that previous processes make use of excessive moistures thus resulting in expensive processing costs. It is furthermore important to be able to expand tobacco lamina with the same ease that it takes to expand stems. The anatomical and chemical structure of stems are such that they are herbaceous plants consisting of pith, primary xylem, vascular rays and cortex. They are also rich in paranchyma cells. The cells are rectangular and the walls are thickened by the deposition of cellulose and pectin compounds. The paranchyma are not as prevalent in lamina and therefore the laminal will not expand as readily as stem. However both lamina and stems contain pores which permit the passage of gases. It is accordingly an object of this invention to provide an improved method for treating tobacco with hydrogen peroxide and catalase. It is another object of this invention to provide a method for expanding tobacco to a greater degree through the use of negative pressure. It is futhermore an object of this invention to provide a more economical means of treating tobacco with hydrogen peroxide and catalase.

SUMMARY OF THE INVENTION

The objects of this invention have been achieved by the process of expanding tobacco which comprises the steps of applying on the surface of tobacco solutions of hydrogen peroxide and catalase so that one or both solutions penetrate the cells of the tobacco, exposing the tobacco to negative pressure whereby atmospheric pressure is removed from the tobacco allowing the cells to easily expand without having an opposing pressure operating, drying the tobacco. The catalase and hydrogen peroxide may also be applied in an atmosphere of negative pressure.

DESCRIPTION OF THE PREFERRED EMBODIMENTS

The essential feature of the process of this invention is the carrying out of a reaction between catalase and hydrogen peroxide from within the cell walls.

The order of applying the catalase and hydrogen peroxide is not critical. A solution containing catalase may first be applied, then a solution containing hydrogen peroxide or vice versa. Also, the catalase and hydrogen peroxide may be applied in the same solution in which case a delayed catalase is preferred. Moreover the catalase and hydrogen peroxide if applied from separate solutions may be forced into the interstices of the tobacco at the same time, or one at a time. The tobacco may be exposed to negative force in various ways. For instance a condition of suction may be induced whereby tobacco is transmitted through a cylinder or chamber of reduced or negative atmospheric pressure. A steam system may also be induced to set up an atmosphere of negative pressure whereby tobacco may be placed immediately after treatment. It is important that too much time not elapse between the time the catalase and hydrogen peroxide are applied and the time the tobacco enters negative atmospheric pressures. Tank vacuum cleaners are a good example of the type of negative atmospheric pressure needed to efficiently induce increased tobacco expansion. It is possible that by achieving maximum efficiency (Oxygen gas) from the reaction of catalase and hydrogen peroxide it is possible to keep moisture levels under 30% and achieve the same degree of expansion as could be experienced by saturating the tobacco. Exposure to negative pressures almost immediately after application of catalase and hydrogen peroxide is important so that the oxygen gas given off is not allowed to escape into the atmosphere but trapped in the tobacco where it can easily press against the cell wall causing expansion.

EXAMPLE 1

10 pounds of flue cured cigarette cut lamina containing 10% moisture was treated with 12% hydrogen peroxide and catalase in amounts of 4ml per liter of water so that the moisture did not exceed 28%. Immediately after application of the liquide the tobacco was sucked into a long cylindrical pipe in which the atmospheric pressure was reduced. The tobacco was carried along this pipe to a drying chamber where the moistures were brought down to 12%. The per cent increase in expansion over a control sample was 105%.

EXAMPLE II

The sample tobacco was treated with hydrogen peroxide and catalase in the same proportions as in example 1, except that the moisture levels were 55%. A pressing means (rollers) were applied to press out excess moisture and reduced to 37%. The tobacco was dried to 12%. The percent increase in expansion over a control sample was 75%.

One can readily see that a lesser quantity of liquide is needed to do a more efficient puffing job and moistures may be kept to a minimum rather than having to reduce excessive moistures and therefore produce elevated costs.

EXAMPLE III 10 pounds of cigar lamina (pa. filler) was placed in an atmosphere of negative pressure through the use of steam whereby hydrogen peroxide (12%) and catalase (4ml per liter water) were sprayed on. Moistures were 30%. The tobacco after expansion was transferred to a dryer where moistures were reduced to 14%. Expansion over a control sample was 110%.

EXAMPLE IV

The same experiment was performed in atmospheric pressure with moistures of 50%. A metal plate was used to press out excess moistures to 40%. After drying expansion was 72%.

EXAMPLE V 10 pounds of rolled cigar stems were treated with hydrogen peroxide (12%) and catalase (4ml per liter of water) with moistures of 25% and sucked into a chamber of reduced atmospheric pressure. After drying to 16% moistures expansion increase over a control showed 150%.

EXAMPLE VI

The same experiment was performed eliminating the atmospheric pressure reduction and using moistures of 55%. The stems after drying to 16% moisture showed expansion increases of 90%.

EXAMPLE VII 10 pounds of burley cigarette stems were treated with hydrogen peroxide (17% and catalase 4 1/2ml per liter water) with moistures of 22%. The tobacco was immediately sucked into a pipe containing reduced pressure. After drying to 10% the expansion was measured at 170%.

EXAMPLE VIII

The same experiment was performed with moistures of 60% which was pressed out with a weight to 45%. The stems were dried down to 12% moistures and the expansion was measured at 100%.

I claim:

1. The method of treating tobacco which comprises distributing on the tobacco a liquid solution containing catalase and a liquid solution containing hydrogen peroxide and surrounding the tobacco with an atmosphere of negative pressure after the catalase and hydrogen peroxide have permeated the interstices of the tobacco and begin to react to cause expansion of the tobacco cells under negative pressure.

2. The method in accordance with claim 1 wherein a catalase solution is first applied and then a hydrogen peroxide solution is applied.

3. The method in accordance with claim 2 wherein the catalase is delayed catalase.

4. The method in accordance with claim 1 wherein a hydrogen peroxide solution is first applied and then a catalase solution is applied.

5. The method in accordance with claim 1, wherein a liquid solution containing both catalase and hydrogen peroxide can be applied on the surface of the tobacco.

6. The method in accordance with claim 1 wherein the tobacco is whole leaf.

7. The method in accordance with claim 1 wherein the tobacco is cut lamina.

8. The method in accordance with claim 1 wherein the tobacco is whole or cut ribs and stems.

9. The method in accordance with claim 1, wherein the tobacco is finished reconstituted tobacco sheet.

* * * * *